US006244738B1

(12) United States Patent
Yasuda et al.

(10) Patent No.: US 6,244,738 B1
(45) Date of Patent: Jun. 12, 2001

(54) STIRRER HAVING ULTRASONIC VIBRATORS FOR MIXING A SAMPLE SOLUTION

(75) Inventors: Kenji Yasuda, Hiki-gun; Takeshi Sakamoto, Asaka, both of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/316,148

(22) Filed: May 21, 1999

(30) Foreign Application Priority Data

Jun. 11, 1998 (JP) ..... 10-163214

(51) Int. Cl.[7] ..... B01F 11/02
(52) U.S. Cl. ..... 366/114; 366/127
(58) Field of Search ..... 366/114, 116, 366/127; 422/128; 210/748; 134/1, 184

(56) References Cited

U.S. PATENT DOCUMENTS 2,578,505 * 12/1951 Carlin .
3,425,951 * 2/1969 Ishiwata .
4,168,295 * 9/1979 Sawyer ..... 366/114
4,302,112 * 11/1981 Steenstrup ..... 366/114
4,339,247 * 7/1982 Faulkner et al. ..... 210/748
4,352,570 * 10/1982 Firth ..... 366/127
4,433,916 * 2/1984 Hall ..... 366/114
4,483,571 * 11/1984 Mishiro ..... 134/184
4,572,673 * 2/1986 Porter et al. ..... 366/127
4,686,406 * 8/1987 Meitzler ..... 366/127
4,834,124 * 5/1989 Honda ..... 134/184
5,326,164 * 7/1994 Logan ..... 366/127
5,484,573 * 1/1996 Berger et al. ..... 422/128
5,538,628 * 7/1996 Logan ..... 366/127
5,688,405 * 11/1997 Dickinson et al. ..... 210/748
5,688,406 * 11/1997 Dickinson et al. ..... 366/127

OTHER PUBLICATIONS

Journal of Micromechanical Microengineering, vol. 3, 1993, "Microfluidics—A Review", P. Gravesen et al, pp. 168—182.
Physical Acoustics, vol. 2B, Academic Press, 1965, "Acoustic Streaming", W. P. Mason, pp. 265—331.

* cited by examiner

*Primary Examiner*—Charles E. Cooley
(74) *Attorney, Agent, or Firm*—Mattingly, Stanger & Malur

(57) ABSTRACT

A stirrer for mixing a sample solution. In order to make a structure wherein drops are not liable to remain in a channel without an increase in flow resistance in a microtube, ultrasonic vibrators are arranged in the stirring tube and plural sample solutions to be mixed are stirred and mixed by an acoustic streaming from ultrasounds generated by the vibrators.

9 Claims, 4 Drawing Sheets

STIRRER HAVING ULTRASONIC VIBRATORS FOR MIXING A SAMPLE SOLUTION

BACKGROUND OF THE INVENTION

The present invention relates to a technique for mixing and stirring a fluid in a channel by radiation of ultrasound.

The technique for mixing a fluid (in which particles may be incorporated) in a microdevice for microfabrication is essential for achieving chemical microanalysis such as micro TAS. However, in a channel for microfabrication whose cross sectional area is extremely smaller than its length, wherein a solution flows at high speed, a laminar flow easily occurs in the channel. Thus, in order to stir and mix different solutions effectively in the channel, it is necessary to build a special structure in the channel. For example, techniques have been proposed such as bending the channel into a dog-legged shape repeatedly whereby, the direction of the stream of a solution is constantly changed to prevent occurrence of a laminar flow; or a number of blowing-out openings are made in walls of the channel in which sample solutions flow and a reactant agent is sprayed from these openings and mixed (see P. Gravesen at al. Microfluidics: a review, J. Micromech. Microeng. Vol. 3 (1993) pp. 168–182).

Incidentally, it has been known since the 19th century that ultrasound irradiation makes it possible to trap particles in a fluid without contact or cause a liquid to flow. For example, W. L. Nyborg introduced ultrasonic flow phenomena that ultrasound irradiation causes the liquid itself to flow, in the chapter "Acoustic Streaming" of Physical Acoustics Vol. 2B, Ed. W. P. Mason, Academic Press, 1965.

These phenomena have been considered to be caused by a gradient of ultrasound intensity. In order to obtain a larger driving force, it has been known to increase the change in spatial distribution of ultrasonic energy density or enlarge a decrease in ultrasound in a fluid.

SUMMARY OF THE INVENTION

As described above, conventional microfabrication stirring techniques are realized by making the structure of the channel complicated. This however causes an increase in inner resistance in the channel, so that a further pressure becomes necessary for the introduction of sample solutions. Thus, it becomes necessary to improve pressure resistance of joint portions of a device. Moreover, drops of the sample remain, so that the samples may be mixed and made muddy in a case where plural samples are in turn treated in the same channel.

An object of the present invention is to provide a stirrer having a structure which does not cause an increase in flow resistance in a microtube and is not susceptible to drops remaining in the channel.

To attain the above-mentioned object, the stirrer of the present invention comprises plural ultrasonic vibrators asymmetrically arranged on walls of the channel or its periphery in a stirring tube, so that ultrasounds act on the downstream side of an introducing portion for introducing plural fluids to be stirred, in a direction perpendicular to the direction of the sample stream in the channel of the tube, and further so that asymmetric acoustic intensity distribution is generated; and a means for stirring and mixing the plural sample fluids by an acoustic streaming generated from the ultrasounds that the ultrasonic vibrators generate.

Moreover, the stirrer of the present invention comprises a means for radiating, into the channel, ultrasound having a frequency different from a frequency of a standing wave generated from the ultrasound vibrators symmetrically arranged on the walls at the both sides of the channel to stir and mix the plural sample fluids. Alternatively, the stirrer comprises a means for vibrating the walls of the channel directly by the vibration of the ultrasound vibrators so as to prevent the sample fluids from being absorbed onto the walls or remaining thereon.

DESCRIPTION OF THE PREFERRED EMBODIMENTS

Embodiment I

Figure 1:
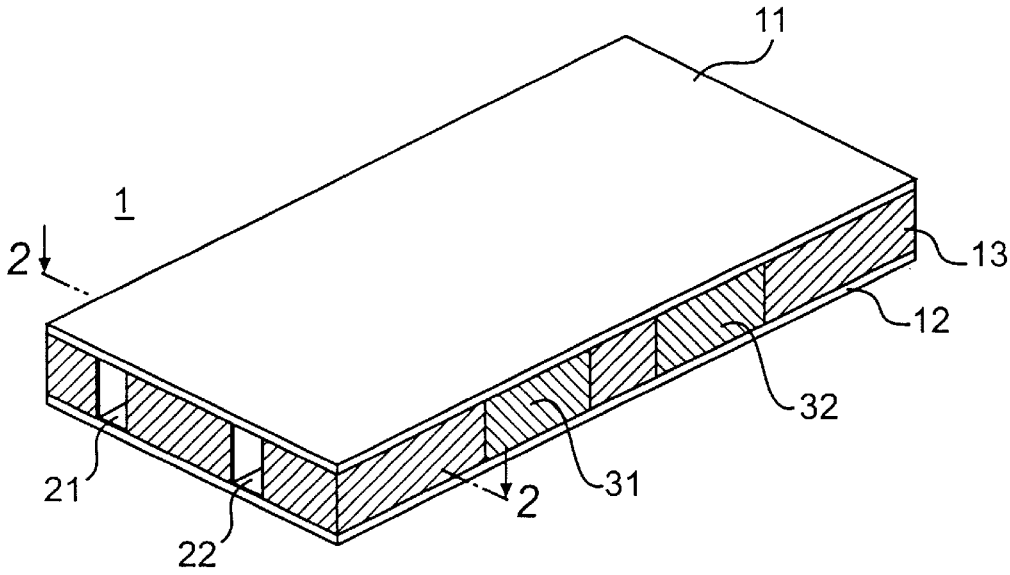
FIG. 1 is a perspective view illustrating a basic structure of a first embodiment of the present invention.
Figure 2:
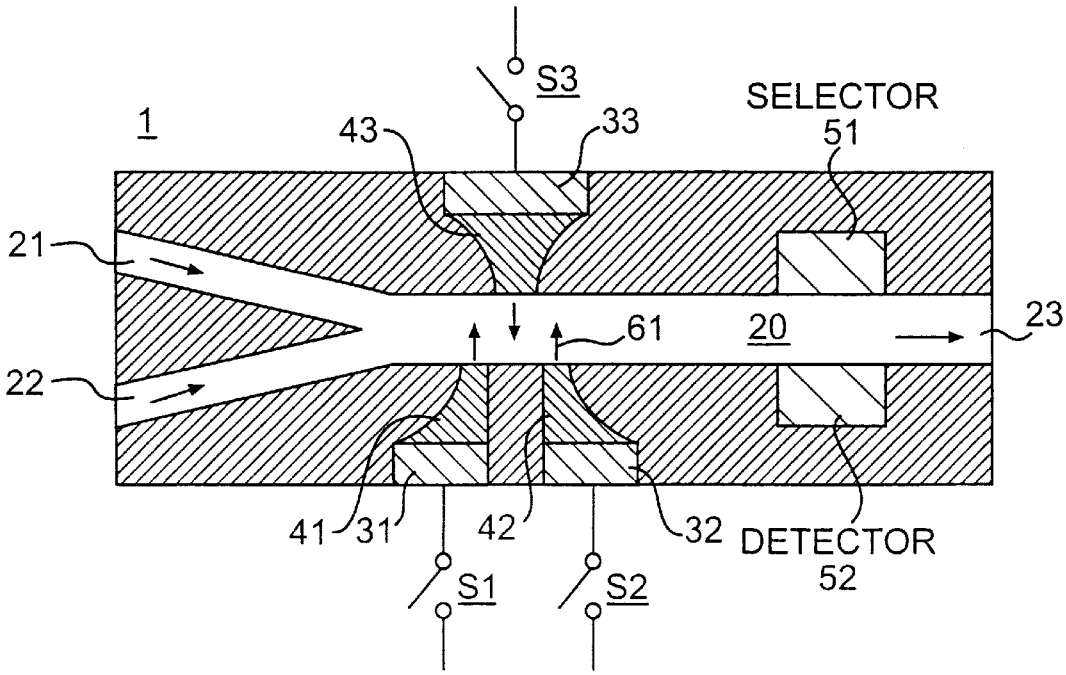
FIG. 2 is a sectional view taken along line 2—2, in FIG. 1.
Figure 3A:
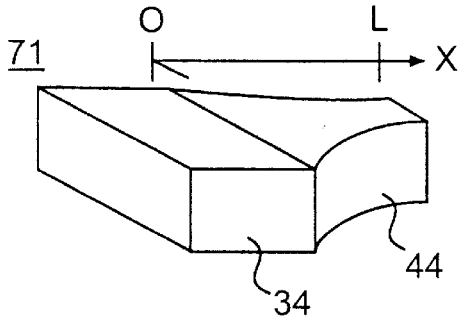
FIGS. 3A–3E illustrate the shapes of acoustic horns used in embodiment I illustrated in FIG. 1.
Figure 3B:
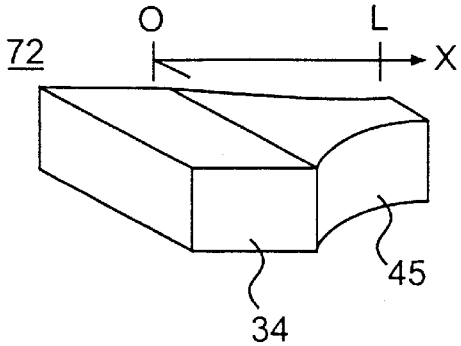
Figure 3C:
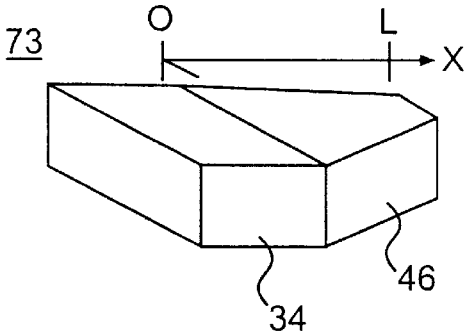
Figure 3D:
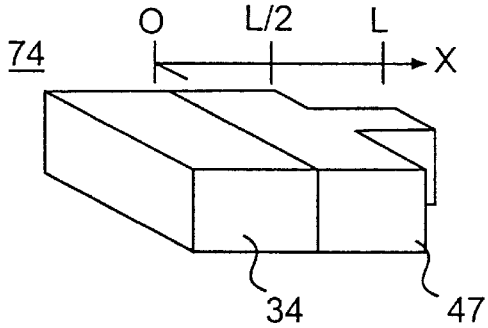
Figure 3E:
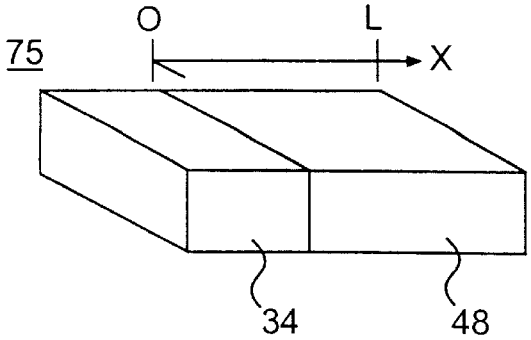

A first embodiment I of a stirrer of the present invention will be described hereinafter, referring to FIG. 1, which is a perspective view. FIG. 2 illustrates a section of the stirrer 1 of the embodiment I taken along line 2—2 shown in FIG. 1. In FIGS. 1 and 2, reference numerals 11, 12 and 13 represent an upper plate of a device tube, a lower plate thereof and a spacer, respectively. Reference numerals 21 and 22 represent channels for introducing sample fluids to be mixed to a stirring chamber having a mixing channel 20, and reference numeral 23 represents an outlet for a mixed sample solution. Reference numerals 31, 32 and 33 represent ultrasonic vibrators. Reference numerals 41, 42 and 43 present acoustic horns. Arrows 61 represent radiation directions of ultrasounds radiated from the ultrasonic vibrators. Reference numerals 51 and 52 represent opposed optical detectors for detecting characteristics of the mixed sample solution. In the present embodiment, the ultrasonic vibrators 31, 32 and 33 are alternately arranged at both sides of the channel 20 so that radiated ultrasounds become asymmetric. The ultrasounds generated from the respective ultrasonic vibrators 31, 32 and 33 are introduced into the acoustic horns 41, 42 and 43 which are alternately arranged along walls of the channel 23 so that more intense ultrasounds are radiated from narrower sections in directions perpendicular to directions of the streams of the sample solutions. Since the radiation directions of the ultrasounds are alternate and asymmetric, the intensity distributions of the radiated ultrasounds become asymmetric, so that an effective acoustic streaming is generated in the direction of the arrows 61.

Electric energy applied to the ultrasonic vibrators 31, 32 and 33 is turned on or off as the occasion demands. Therefore, it is advisable that excitation voltages are applied to these ultrasonic vibrators 31, 32 and 33 through switches. In FIG. 2, symbols S1 to S3 represent switches.

The device of the present embodiment does not have any structure that disturbs a laminar flow in its channel, and radiates ultrasound which is one type of non-contact forces, from its smooth tube wall. Therefore, stirring is performed so that the sample solutions can be stirred and flowed through the channel without any rise in flow resistance.

Figure 4:
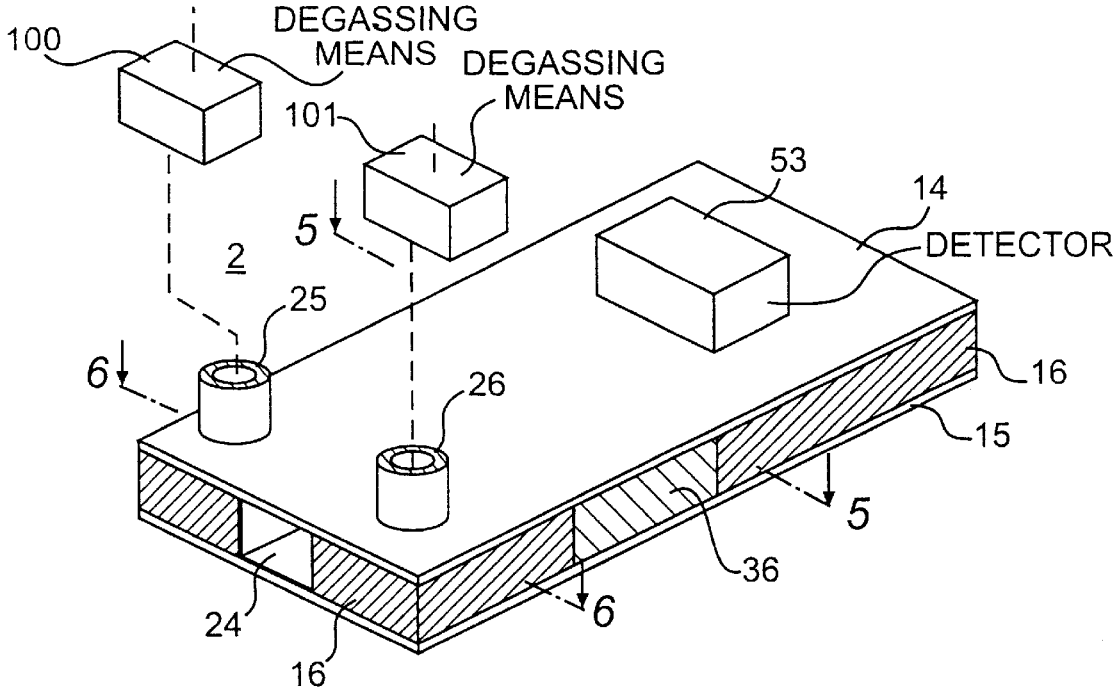
FIG. 4 is a perspective view illustrating a basic structure of a second embodiment of the present invention.

Additionally, remaining drops caused by unevenness of the channel are not produced. A problem that arises in a case where ultrasound is used is damage of samples originating from cavitation generated from the ultrasound. In the case where the sample solutions contain, in particular, biological samples such as cells, it is essential to adopt a means for suppressing cavitation generation. As a ratio of the sample solutions to dissolved air becomes higher, a cavitation threshold becomes higher so that the cavitation is not liable to be generated. Therefore, it is allowable as a manner for suppressing the ultrasonic cavitation that a silicone tube having a film thickness of about 80 $\mu$m is sealed into a vacuum chamber, and sample solutions are allowed to pass through this silicone tube. Degassing means 100 and 101 shown in FIG. 4 are used to degas the dissolved air, and subsequently sample solutions are introduced into the channels 21 and 22 through the degassing means 100 and 101 as shown in dotted lines in FIG. 4. Alternatively, the generation of cavitation can be suppressed by ultrasound having a high frequency because the threshold of acoustic pressure at the time of the generation of the cavitation is in proportion to the ultrasonic frequency to the power 1.2. Thus, the generation of the cavitation can be suppressed, without any pretreatment in a degassing process, by using a frequency of 1 MHZ or higher as the frequency of the ultrasound used in the present invention. The generated intensity of the acoustic streaming increases in proportion to the second power of the frequency of the ultrasound. In order to perform stronger stirring, therefore, it is desired to use ultrasound having a high frequency. In general, however, the absorption of ultrasound that may damage the sample also increases in proportion to the second power of the frequency of the ultrasound.

In order to generate the acoustic streaming efficiently without any damage to the sample, it is desired to use ultrasound having a frequency of lower than 10 MHz.

FIGS. 3A–3E illustrates the shapes of the acoustic horns used in the embodiment I illustrated in FIG. 1. Each of ultrasound generators 71–75 illustrated in FIGS. 3A–3E comprises an ultrasonic vibrator 34 and acoustic horns 44, 45, 46, 47, or 48 in various shapes respectively. The ultrasonic vibrator of the ultrasonic generator is desirably arranged to radiate ultrasound in a 33 mode in a direction of an arrow x in the figures. At the time, thickness of the ultrasonic vibrator is desirably set to ($\lambda$/2) according to the frequency $\lambda$ of ultrasound used. The ultrasonic vibrator however, may be used in a 31 mode in a direction perpendicular to the x axis. In the case wherein minute apparatus such as an ultrasonic vibrator is used, it is in general difficult for the vibrator independently to generates intense ultrasound, sufficient to generate an acoustic streaming, concentrically at minute areas because of problems about applying voltages and the shape of the element. Thus, it is desirable to use an amplifying element such as an acoustic horn 44 so as to output a large amplitude from a minute amplitude. The exponential type acoustic horn 44 is worked so that, with an increase in position x, the sectional area S(x) of the horn decreases according to Exp ($-\lambda x$), wherein $\gamma$ is a taper constant. The catenoidal type acoustic horn 45 is worked so that, with an increase in position x, the sectional area S(x) thereof decreases according to $\cosh^2(x/h)$, wherein h is a taper constant. The conical type acoustic horn 46 is worked so that, with an increase in position x, the sectional area S(x) thereof decreases according to $Ax^2$, wherein A is a taper constant. The stepwise acoustic horn 47 is worked so that, with an increase in position x, the sectional area S(x) thereof decreases in a manner that at the point where $x=(L/2)=(\lambda/4)$ the area $S=S_1$ is decreased to $S=S_2$. The resonance plate type acoustic horn 48 is worked so that, with an increase in position x, the sectional area S(x) is constant but the length L thereof becomes $\lambda/2$ or $(n\lambda+\lambda/2)$, wherein n is a natural number. Comparing characteristics of the exponential, catenoidal, and conical types of horns in coordinates L, the catenoidal type has the largest ratio of vibration speeds and the conical type has the smallest ratio of vibration speeds. Moreover, length L is shortest in the catenoidal type and is longest in the conical type. Therefore, amplifying efficiency is the best in the catenoidal type, but in this type it is necessary to use, as a raw material of the horn, a raw material having a high resistance against fatigue, such as a titanium alloy (ICI318A). Further, the working of its shape is also more complicated and difficult than the conical type. In the present embodiment, a suitable means (horn) can be selected in accordance with required amplifying characteristics and working costs.

Embodiment II

Figure 5:
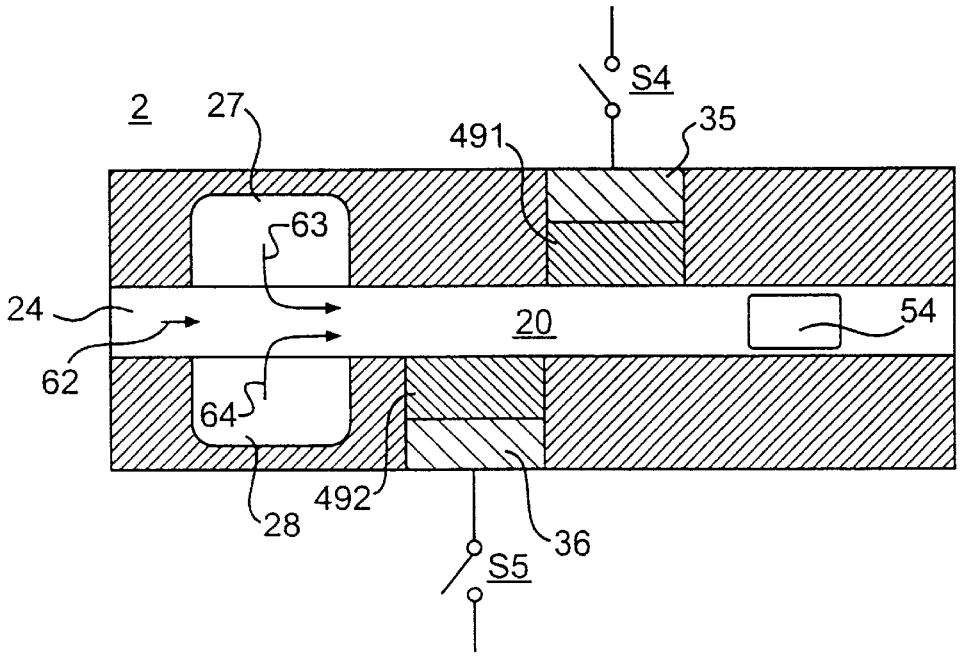
FIG. 5 is a sectional view taken along line 5—5 in FIG. 4.
Figure 6:
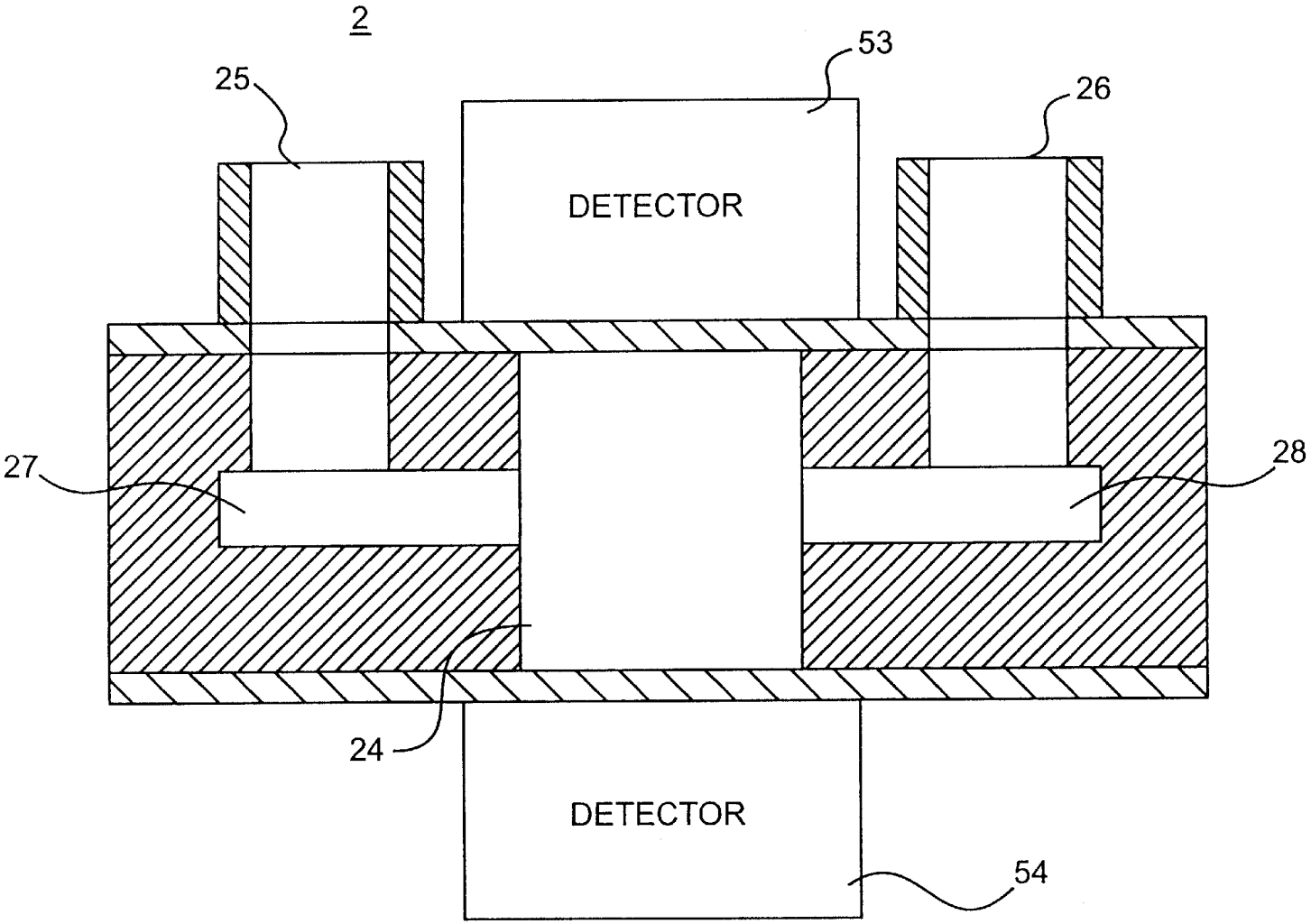
FIG. 6 is a sectional view taken along line 6—6 in FIG. 4.

A second embodiment of the stirrer of the present invention will be described hereinafter, referring to FIG. 4, which is a perspective view. FIG. 5 is a sectional view taken along line 5—5 in FIG. 4. FIG. 6 is a cross sectional view taken along line 6—6 in FIG. 4. In FIGS. 4–6, reference numerals 14, 15 and 16 represent an upper plate of a device tube, a lower plate thereof and a spacer, respectively. Reference numeral 24 represents a mixing channel in which sample solutions pass through. Reference numerals 25 and 26 represent solution inlets for introducing sample solutions to be mixed. Spaces 27 and 28 contact with the channel 24. Sample solutions introduced from the solution inlets 25 and 26 flow in the directions of arrows 63 and 64, respectively, and then are put together into sample solutions 62 in the channel 24. Next, ultrasounds generated from ultrasonic vibrators 35 and 36 are amplified by resonance plates 491 and 492, to be radiated onto the channel 24 in the direction perpendicular to the stream of the solution. At this time, by using a frequency which does not generate a standing wave in the channel as a frequency of the ultrasound used, the stream of the ultrasound for stirring sample solutions is generated. Specifically, when the wavelength of the ultrasound used is, for example, $\lambda/2$ or $(\lambda/2+n\lambda)$, a standing wave is generated. Thus, ultrasound having a frequency which does not satisfy this condition is desirable for practical use. Reference numerals 53 and 54 represent the optical detection units for detecting characteristics of the mixed sample solution. The detection units make it possible to measure reaction results of the stirred and mixed sample solution.

In FIG. 5, symbols S4 and S5 are switches. They are disposed depending on the necessity of the excitation of the ultrasonic vibrators 35 and 36.

In the present embodiment, the resonance plates 491 and 492 are used, but other acoustic horns as illustrated in FIG. 3 may be used. In the same way as in the first embodiment shown in FIG. 1, it is allowable as a manner for suppressing ultrasonic cavitation that a silicone tube having a film thickness of about 80 $\mu$m is sealed into a degassing chamber, and sample solutions are allowed to pass in this silicone tube to degas the dissolved air, and subsequently the sample solutions are introduced into the channels 21 and 22. Alternatively, the threshold of acoustic pressure at the time of generation of cavitation is in proportion to the ultrasonic frequency to the power 1.2 and, therefore, the generation of the cavitation may be suppressed without any pre-processing based degassing process by using ultrasound having a frequency of 1 MHz or higher as the frequency of the ultrasound used in the present embodiment. The generated intensity of an acoustic streaming increases in proportion to the second power of the frequency of the ultrasound. In order to perform stronger stirring, therefore, it is desired to use ultrasound having a high frequency. In general, however, the absorption of ultrasound that may damage a sample also increases in proportion to the second power of the frequency of the ultrasound.

Therefore, in order to generate an acoustic streaming efficiently without damaging a sample, it is desired to use ultrasound having a frequency of lower than 10 MHz.

In the present embodiment, the sectional shape of the channel is a rectangular parallelpiped and two opposite faces are parallel to each other. However, shapes having faces which are not parallel may be used, such as trapezoid, elliptic and arc shapes.

As described in detail, the present invention has advantages that samples in a microtube can be stirred and mixed without any rise in flow resistance.

What is claimed is:

1. A stirrer comprising an introducing portion for introducing plural sample fluids to be stirred into a stirring chamber having a channel;

plural ultrasonic vibrators arranged on walls of the channel or its periphery and opposed asymmetrically at both sides of the channel so that ultrasounds act on the downstream side of the introducing portion in a direction perpendicular to the direction of the stream of the sample fluids in the channel of the stirring chamber and further so that asymmetric acoustic intensity distribution is generated;

said ultrasonic vibrators constituting means for stirring the plural sample fluids by an acoustic streaming from the ultrasounds generated by the ultrasonic vibrators whereby the radiation directions of the ultrasounds are alternate and asymmetric and the intensity distributions of the radiated ultrasounds become asymmetric so that an effective acoustic streaming is generated.

2. The stirrer according to claim 1, wherein the frequency of the ultrasound generated from the ultrasonic vibrators is 1 MHz or higher.

3. The stirrer according to claim 1, wherein the frequency of the ultrasound generated from the ultrasonic vibrators is lower than 10 MHz.

4. The stirrer according to claim 1, further comprising a means for degassing air dissolved in the fluids at a front section of the introducing portion for introducing the sample fluids into the stirring chamber.

5. The stirrer according to claim 1, further comprising a switch for turning on or off energy for controlling the ultrasonic vibrators.

6. The stirrer according to claim 1, wherein the ultrasonic vibrators further comprise acoustic horn units for amplifying the generated ultrasound.

7. The stirrer according to claim 6, wherein the ultrasonic vibrators comprise acoustic horn units which are for amplifying the generated ultrasound and have a sectional shape whose area of sections decreases according to exponential, catenoidal, conical or stepwise modes, toward its tip.

8. A sample solution mixing device comprising:

a first plate;

a second plate opposed to said first plate;

a plurality of sample solution channels formed between said first plate and said second plate, in each of which a different sample solution is provided;

a mixing channel formed between said first plate and said second plate, at one end of which said plurality of sample solution channels are connected; and plural ultrasonic vibrators arranged on walls of the channel or its periphery and opposed asymmetrically at both sides of said mixing channel so as to generate an asymmetric acoustic intensity distribution in said mixing channel, and so as to cause ultrasounds generated by said ultrasonic vibrators to act on said different sample solutions flowing in said mixing channel in a direction perpendicular to a direction of flow of said different sample solutions; and wherein said different sample solutions to be mixed are mixed and stirred to form a mixed sample solution in a region irradiated by the ultrasounds in said mixing channel and said mixed sample solution flows toward an outlet of said mixing channel.

9. A sample solution mixing device comprising:

a first plate;

a second plate opposed to said first plate;

a plurality of sample solution channels formed between said first plate and said second plate, in each of which a different sample solution flows;

a mixing channel formed between said first plate and said second plate, said plurality of sample solution channels being connected to said mixing channel, and said different sample solutions flow into said mixing channel;

plural ultrasonic vibrators arranged on walls of the channel or its periphery and opposed asymmetrically at both sides of said mixing channel so as to generate an asymmetric acoustic intensity distribution in said mixing channel, and so as to cause ultrasounds generated by said ultrasonic vibrators to act on said different sample solutions flowing in said mixing channel in a direction perpendicular to a direction of flow of said different sample solutions, and wherein said different sample solutions to be mixed are mixed and stirred to form a mixed sample solution in a region irradiated by the ultrasounds in said mixing channel and said mixed sample solution flows toward an outlet of said mixing channel; and optical detectors on opposite sides of said mixing channel which detect a characteristic of said mixed sample solution at a position between the region irradiated by the ultrasounds and said outlet of said channel.

* * * * *